US007403720B2

(12) United States Patent
Nomura et al.

(10) Patent No.: US 7,403,720 B2
(45) Date of Patent: Jul. 22, 2008

(54) IMAGE-FORMING APPARATUS HAVING PROCESS CARTRIDGE AND COLOR SHIFT ESTIMATION

(75) Inventors: Yujiro Nomura, Nagano (JP); Noriaki Shimura, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

(21) Appl. No.: 11/302,317

(22) Filed: Dec. 12, 2005

(65) Prior Publication Data

US 2006/0146378 A1 Jul. 6, 2006

(30) Foreign Application Priority Data

Dec. 20, 2004 (JP) ..... P2004-367632
Dec. 20, 2004 (JP) ..... P2004-367633

(51) Int. Cl.
*G03G 15/00* (2006.01)

(52) U.S. Cl. ..... 399/12; 399/301

(58) Field of Classification Search ..... 399/12, 399/13, 24, 25, 40, 66, 301; 347/117
See application file for complete search history.

(56) References Cited

U.S. PATENT DOCUMENTS

| | | | | |
|---|---|---|---|---|
| 5,452,073 | A * | 9/1995 | Kataoka | 399/299 |
| 5,708,912 | A | 1/1998 | Lee | 399/24 |
| 6,278,857 | B1 | 8/2001 | Monji et al. | 399/301 |
| 6,626,101 | B2 * | 9/2003 | Kajiwara et al. | 101/171 |
| 6,685,290 | B1 * | 2/2004 | Farr et al. | 347/7 |
| 6,853,392 | B2 * | 2/2005 | Maeda | 347/116 |
| 7,054,567 | B2 * | 5/2006 | Furno et al. | 399/38 |
| 7,192,113 | B2 * | 3/2007 | Deer et al. | 347/15 |
| 7,251,055 | B2 * | 7/2007 | Sawada et al. | 358/1.9 |
| 2002/0127021 | A1 | 9/2002 | Chihara | 399/12 |
| 2002/0143893 | A1 | 10/2002 | Nakazono et al. | 709/217 |
| 2005/0031361 | A1 * | 2/2005 | Kobayashi | 399/49 |
| 2005/0084293 | A1 * | 4/2005 | Fukuchi et al. | 399/167 |

FOREIGN PATENT DOCUMENTS

| | | | |
|---|---|---|---|
| JP | 08-211818 | | 8/1996 |
| JP | 10105021 | A * | 4/1998 |
| JP | 2000-250285 | | 9/2000 |
| JP | 2000330448 | A * | 11/2000 |
| JP | 2002072610 | A * | 3/2002 |
| JP | 2002-268478 | | 9/2002 |
| JP | 2002-287920 | | 10/2002 |
| JP | 2003029490 | A * | 1/2003 |

* cited by examiner

*Primary Examiner*—Robert Beatty
(74) *Attorney, Agent, or Firm*—Hogan & Hartson LLP

(57) ABSTRACT

An image-forming method performed in an image forming apparatus which includes: a first memory, storing first information indicative of a first factor causing color shift; and a detachable process cartridge, provided with an image carrier and a second memory storing second information indicative of a second factor causing the color shift, the method including: reading out the first information and the second information when the image forming apparatus recognizes an attachment of the process cartridge, obtaining an estimated color shift caused by the first factor and the second factor, based on the first information and the second information; judging whether the estimated color shift is within a predetermined range; and performing an initialization of the process cartridge when it is judged that the estimated color shift is within the predetermined range.

20 Claims, 10 Drawing Sheets

IMAGE-FORMING APPARATUS HAVING PROCESS CARTRIDGE AND COLOR SHIFT ESTIMATION

TECHNICAL FIELD OF THE INVENTION

The present invention relates to an image-forming apparatus which forms an electrostatic latent image on an image carrier by means of electrophotography and produces a desired output image.

DESCRIPTION OF THE RELATED ART

In a conventionally-developed image-forming apparatus, a photosensitive drum, which is an image carrier, and an electrification device, a development device, a cleaning device, and the like, which are disposed around the photosensitive drum, are assembled into a unit (the thus-formed unit is called a "process cartridge"). The unit is made removably attached to the main body of an apparatus, thereby making it easy for a user, or the like, to replace a depleted article.

Another, tandem-type color image-forming apparatus has hitherto been proposed in association with colorization of images. This image-forming apparatus comprises a plurality of image-forming stations where an image is to be formed, and images of respective colors; namely, a cyan image, a magenta image, a yellow image, and a black image, are formed on photosensitive elements. The color images are transferred to a transfer medium in an overlapping manner at transfer positions of the respective photosensitive elements, to thus form a full color image. Such a tandem color image-forming apparatus has image-forming sections for respective colors, and hence is very advantageous in terms of speed. However, the tandem-type image-forming apparatus encounters a very big problem in performing accurate registration of the respective images formed by the different image-forming sections. Displacement in the positions on the transfer medium where the images of four colors are formed through transfer appears as color shifts or changes in color tone.

A method for preventing occurrence of the color shifts in the tandem-type color image-forming apparatus is described in JP-A-2000-250285. In this invention, images of registration patterns are formed on four photosensitive elements, each of which has an independent drive motor, and the thus-formed images are transferred onto an intermediate transfer belt in an overlapping manner. In addition to adoption of a heretofore-often-employed method for computing, from the information obtained by reading the patterns on the intermediate transfer belt through use of a CCD sensor, the amount of positional displacement in respective colors with reference to settings, the information read by the CCD sensor is further subjected to filtering, whereby information about eccentricity of the photosensitive elements can be extracted. As a result, occurrence of color shifts can be prevented with much greater accuracy.

However, in the image-forming apparatus described in the above-described official gazette, variations in the diameters of the photosensitive elements or the mechanical precision in assembly of the photosensitive elements, other than the eccentricity of the photosensitive element in each of the image-forming stations, also appear in the form of color shifts. For these reasons, great difficulty is presumed to be encountered in separating these factors from each other in terms of contribution and making amendments.

SUMMARY OF THE INVENTION

The present invention aims at providing an image-forming method which solves the drawbacks of the related art and which uses a process cartridge having at least an image carrier capable of performing registration of images of respective colors with high accuracy in connection with a system for transferring images of colors onto a transfer medium in an overlapping manner.

A first invention is directed to an image-forming method using a process cartridge having at least an image carrier, wherein the process cartridge has memory that stores information about color shift, such as mechanical variations or accuracy, which arises during manufacture or assembly of the process cartridge; the information is read from said memory during replacement of the process cartridge and subjected to arithmetic processing in combination with information about color shift in the memory of the main body of the apparatus; and, when the process cartridge is ascertained to be able to adjust registration as a result of said arithmetic processing, operation for initializing the process cartridge is executed.

A second invention based on the image-forming method of the first invention is characterized in that reading information from the memory of the process cartridge is performed through wireless communication.

A third invention based on the image-forming method of the first invention is characterized in that reading information from the memory of the process cartridge is performed through wired communication.

A fourth invention based on the image-forming method of any one of the first to third inventions is characterized in that replacement of the process cartridge is inhibited during power-off.

In an image-forming method using a process cartridge having at least an image carrier, the process cartridge has memory that stores information about color shift, such as mechanical variations or accuracy, which arises during manufacture or assembly of the processes cartridge; the stored information is read from a main body of an apparatus during replacement of the process cartridge and subjected to arithmetic processing in combination with information about color shift in the memory of the main body of the apparatus; and, when the process cartridge is ascertained to be able to adjust registration as a result of arithmetic processing, operation for initializing the process cartridge is executed. By means of this configuration, the color shift information about the process cartridge and the color shift information about the main body of the apparatus are subjected to computation in combination, and hence high-precision color shift information is obtained. Accordingly, a high-quality color image can be obtained.

By means of the configuration that effects reading of information from the memory of the process cartridge through wireless communication, color shift information about the process cartridge can be read simultaneously with attachment of the process cartridge to the main body of the apparatus. The color shift information can be quickly subjected to arithmetic processing in combination with the color shift information about the main body of the apparatus.

By means of the configuration that effects reading of information from the memory of the process cartridge through wired communication, color shift information about the process cartridge can be read simultaneously with attachment of the process cartridge to the main body of the apparatus. The color shift information can be quickly subjected to arithmetic processing in combination with the color shift information about the main body of the apparatus.

By means of the configuration that inhibits replacement of the process cartridge during power-off, a user-friendly apparatus can be provided without involvement of arithmetic operation every time power is turned on.

A fifth invention is directed to an image-forming method using an image-forming apparatus capable of, at power-off, replacing at least a process cartridge which has at least an image carrier, wherein the process cartridge has memory that stores information about color shift; the information is read from the memory at power on; the read memory information is subjected to arithmetic processing in combination with information about color shift in the memory of the main body of the apparatus; and, when the process cartridge is ascertained to be able to adjust registration as a result of arithmetic processing, operation for initializing the process cartridge is executed.

A sixth invention based on the image-forming method of the fifth invention is characterized in that reading information from the memory of the process cartridge is performed through wireless communication.

A seventh invention based on the image-forming method of the fifth invention is characterized in that reading information from the memory of the process cartridge is performed through wired communication.

In an image-forming method using an image-forming apparatus capable of, at power-off, replacing at least a process cartridge which has at least an image carrier, wherein the process cartridge has memory that stores information about color shift; the information is read from the memory at power on; the read memory information is subjected to arithmetic processing in combination with information about color shift in the memory of the main body of the apparatus; and, when the process cartridge is ascertained to be able to adjust registration as a result of arithmetic processing, operation for initializing the process cartridge is executed. By means of this configuration, the color shift information about the process cartridge and the color shift information about the main body of the apparatus are subjected to computation in combination, and hence high-precision color shift information is obtained. Accordingly, a high-quality color image can be obtained.

By means of the configuration that effects reading of information from the memory of the process cartridge through wireless communication, color shift information about the process cartridge can be read simultaneously with attachment of the process cartridge to the main body of the apparatus. The color shift information can be quickly subjected to arithmetic processing in combination with the color shift information about the main body of the apparatus.

By means of the configuration that effects reading of information from the memory of the process cartridge through wired communication, color shift information about the process cartridge can be read simultaneously with attachment of the process cartridge to the main body of the apparatus. The color shift information can be quickly subjected to arithmetic processing in combination with the color shift information about the main body of the apparatus.

DETAILED DESCRIPTION OF THE INVENTION

Figure 1:
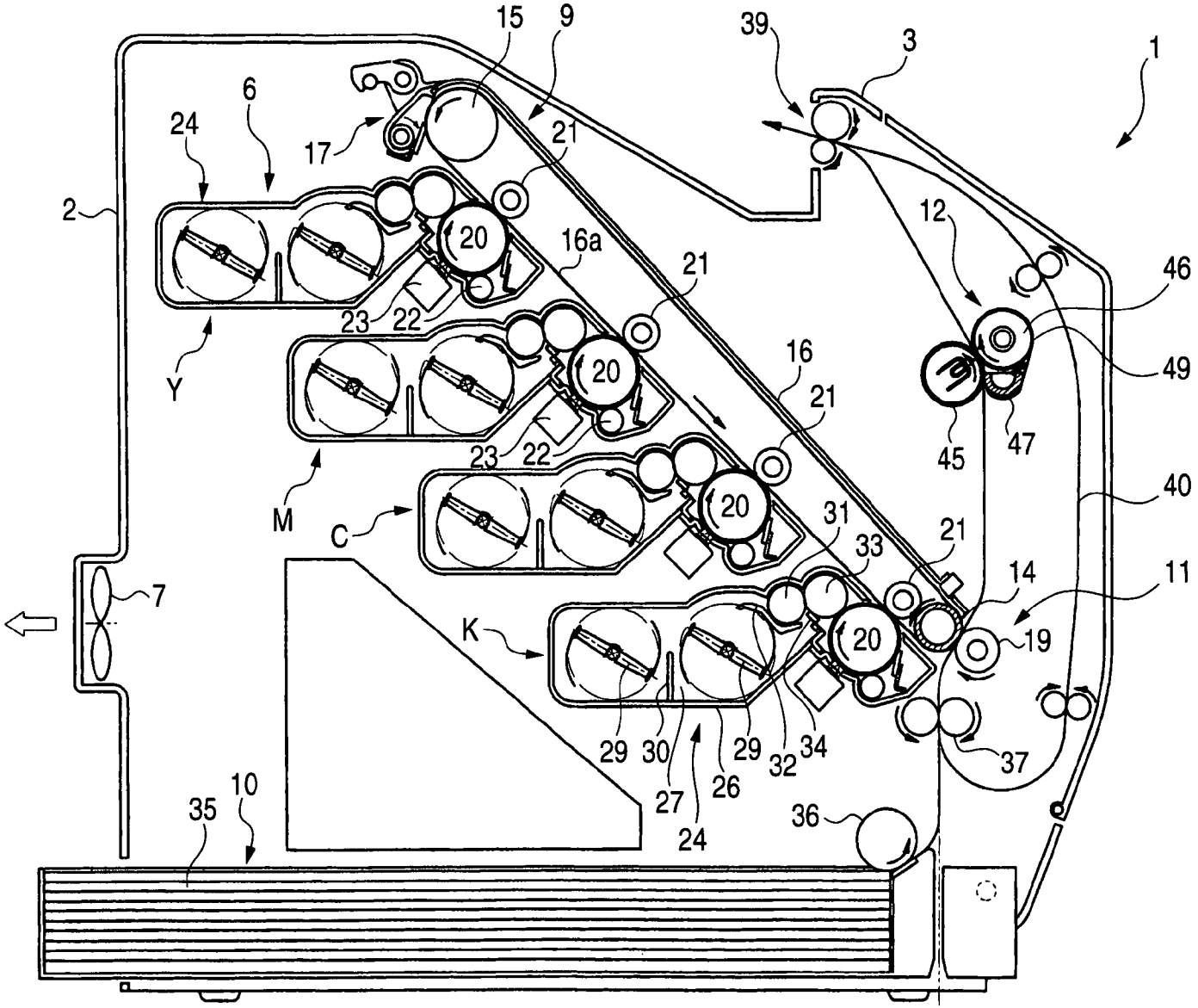
FIG. 1 is a view showing an overall configuration of an embodiment of a color image-forming apparatus.

An embodiment of the present invention will be described by reference to the drawings. FIG. 1 is a view showing an overall configuration of an embodiment of a color image-forming apparatus used for an image-forming method of the present invention. In the following descriptions, there may be a case where the same reference numerals are used throughout the drawings, and their repeated explanations are omitted. The present embodiment is an example where an intermediate transfer belt is used as a transfer belt.

In FIG. 1, an image-forming apparatus 1 of the present embodiment has a housing main body 2. An image-forming unit 6, a transfer belt unit 9, and a sheet-feeding unit 10 are arranged within the housing main body 2. Moreover, a secondary transfer unit 11, a fusing unit 12, and a recording medium transport means 13 are arranged. The image-forming unit 6 and the sheet-feeding unit 10 are configured so that consumable items in these units can be removed from and attached to the housing main body. Therefore, the image-forming apparatus is configured so that the image-forming unit 6, including the transfer belt unit 9, can be removed to undergo repair or replacement.

The transfer belt unit 9 has a drive roller 14, a follower roller 15 placed at a position in an upper oblique direction with reference to the drive roller 14, an intermediate transfer belt 16 which is stretched between the two rollers 14, 15 in a tensioned manner and is circulatory driven in the direction of an illustrated arrow, and cleaning means 17 to be brought into contact with the surface of the intermediate transfer belt 16. In the drawing, the follower roller 15 and the intermediate transfer belt 16 are arranged in a direction sloped in an upwardly leftward direction with respect to the drive roller 14. A belt surface 16*a*, which faces downward when the intermediate transfer belt 16 is driven for transport with respect to the direction of transport, is located in a downward position. In the present embodiment, the belt surface 16*a* is a belt surface which is tensioned during driving of the belt (i.e., a surface withdrawn by the drive roller 14).

Primary transfer members 21 contact, with elastic force, the back of the belt surface 16*a*, which faces downward with respect to the transporting direction of the intermediate transfer belt 16, so as to oppose image carriers 20 of respective image-forming stations Y, M, C, and K to be described later. A transfer bias is applied to the primary transfer members 21.

An registration sensor 18 is disposed on a support frame of the transfer belt unit 9 in close proximity to the drive roller 14. This test pattern sensor 18 is a sensor for positioning toner images of respective colors on the intermediate transfer belt 16, detecting the densities of toner images of respective colors, and correcting occurrence of an color shifts of the respective images of colors or the density of the image.

The image-forming unit 6 comprises image-forming stations of Y (yellow color), M (magenta color), C (cyan color), and K (black color), which form a plurality of (four in the present embodiment) images of four different colors. Each of the image-forming stations Y, M, C, and K comprises an image carrier 20 formed from a photosensitive drum, and electrification means 22, image-writing means 23, and development means 24, which are disposed around the image carrier 20. In the figure, in relation to the development means 24, a reference numeral is assigned to only the K image-forming station. Since the remaining image-forming stations are of identical configuration, their figure numerals are omitted. Further, the respective image-forming stations Y, M, C, and K are arranged in arbitrary sequence.

The image carriers 20 of the respective Y, M, C, and K image-forming stations are brought into contact with the belt surface 16*a*, which faces downward with respect to the transporting direction of the intermediate transfer belt 16. Consequently, the respective image-forming stations Y, M, C, and K are arranged in a direction which slopes upwardly leftward with reference to the drive roller 14 in the drawing. As indicated by the arrow in the drawing, the image carriers 20 are rotationally driven in the transport direction of the intermediate transfer belt 16.

The development means 24 comprises a toner storage container 26 for storing toner (indicated by a hatched area in the drawing); a toner storage section 27 formed within the toner storage container 26; a toner agitation member 29 provided in the toner storage section 27; a partition member 30 which is formed so as to extend to an elevated position within and so as to partition the inside of the toner storage section 27; a toner supply roller 31 placed at a position above the partition member 30; a blade 32 which is provided on the partition member 30 and contacts the toner supply roller 31; a development roller 33 arranged to contact the toner supply roller 31 and the image carrier 20; and a regulatory blade 34 which contacts the development roller 33. Toner is negatively-electrified, non-magnetic, one-component toner. The toner supply roller 31 and the development roller 33 rotate in opposite directions.

The image carrier 20 is rotated in the transporting direction of the intermediate transfer belt 16. As indicated by the illustrated arrow, the development roller 33 is rotationally driven in a direction opposite the rotational direction of the image carrier 20, but the supply roller 31 is rotationally driven in the same direction as that of the image carrier 20. In the mean time, the agitation member 29 is rotationally driven in the direction opposite the rotational direction of the supply roller 31. The toner, which has been agitated and upwardly conveyed by the agitation members 29 within the toner storage section 27, is supplied to the toner supply roller 31 along the upper surface of the partition member 30. The thus-supplied toner comes into frictional contact with the blade 32 and is supplied over the surface of the development roller 33 by means of mechanical adhesion and frictional electrification power to irregularities in the surface of the supply roller 31. The toner supplied to the development roller 33 is limited to a layer of predetermined thickness by means of the regulatory blade 34. The toner layer given a small thickness is transported to the image carrier 20, to thus develop a latent image of the image carrier 20 in a nip section, which is formed as a result of the development roller 33 contacting the image carrier 20, and in the vicinity of the nip section.

The sheet-feeding unit 10 has a paper supply section comprising a sheet-feeding cassette 35 which retains recording mediums P in a stacked manner, and a pickup roller 36 for feeding the recording mediums P one at a time from the sheet-feeding cassette 35. Provided in a first open-and-close member 3 are a pair of registration rollers 37 for determining a timing at which the recording medium P is fed to a secondary transfer section; the secondary transfer unit 11 serving as secondary transfer means to be brought into compressed contact with the drive roller 14 and the intermediate transfer belt 16; the fusing unit 12; the recording medium transport means 13; a pair of sheet-output rollers 39; and a double-sided print transport path 40.

The secondary transfer unit 11 has a secondary transfer roller 19. The secondary transfer roller 19 remains able to press the intermediate transfer belt 16 and the drive roller 14 at all times.

The fusing unit 12 comprises a heating roller 45 which incorporates a heating element, such as a halogen heater, and is rotatable; a pressure roller 46 which presses and impels the heating roller 45; a belt tension member 47 provided to the pressure roller 46 in a swayable manner; and a heat-resistant belt 49 stretched with tension between the pressure roller 45 and the belt tension member 47. A color image transferred to a recording medium by means of secondary transfer is fused to the recording medium at a predetermined temperature at the nip section formed between the heating roller 45 and the heat-resistant belt 49. In the present embodiment, it becomes possible to arrange the fusing unit 12 in a space formed in an upper oblique direction with respect to the intermediate transfer belt 16; in other words, a space opposite the image-forming unit 6 with reference to the intermediate transfer belt 16. As a result, transfer of heat to an electrical equipment box, the image-forming unit 6, and the intermediate transfer belt 16, can be diminished, and the frequency of operation for correcting color shifts can be reduced.

Figure 2:
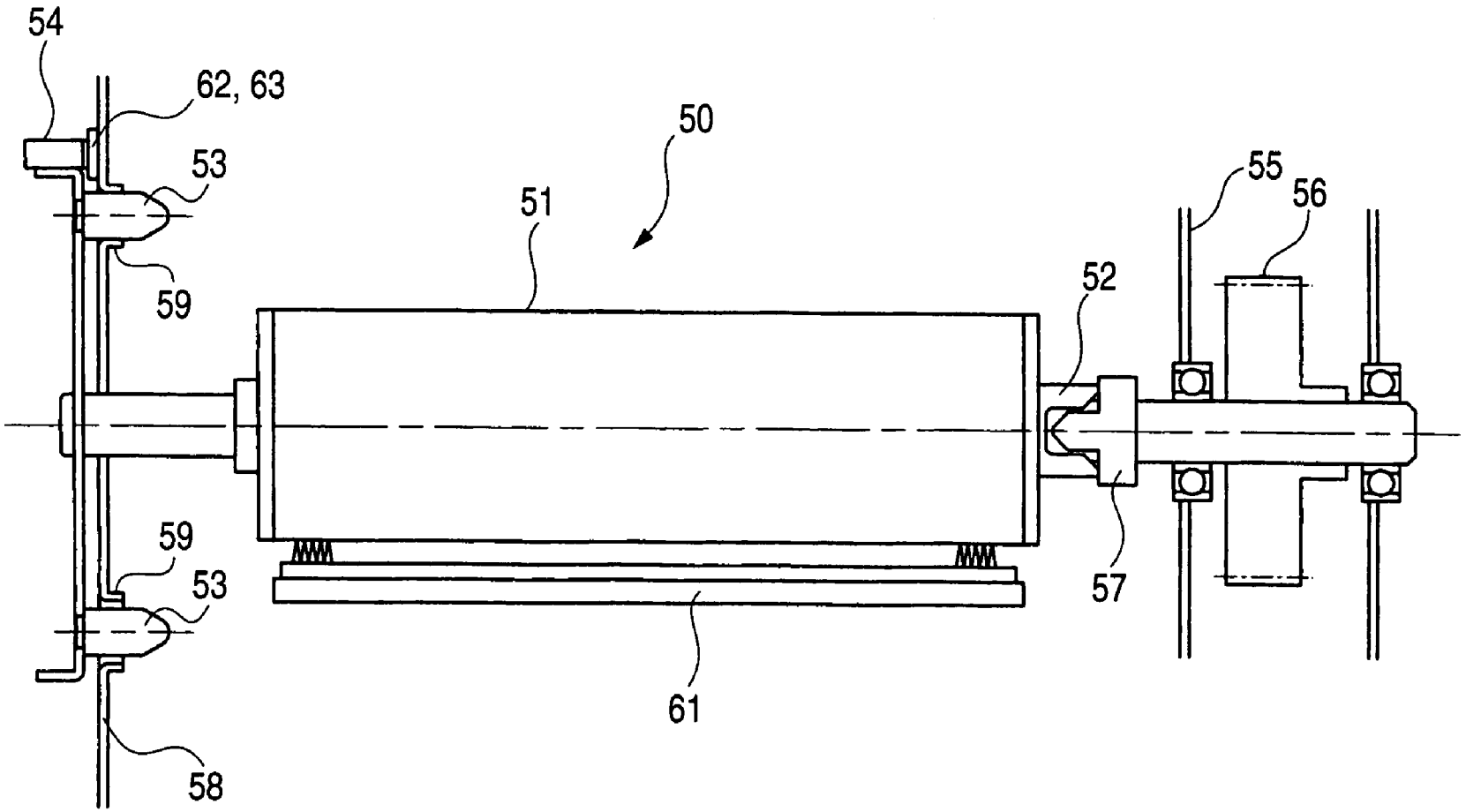
FIG. 2 is a view showing a process cartridge attached to one of the image-forming stations.

FIG. 2 is a view showing that a process cartridge 50 to be attached to each of the image-forming stations in a replaceable manner is attached to the main body of the apparatus. The process cartridge 50 disclosed in the present embodiment has a photosensitive drum 51 in the center. A female coupling 52 to which drive force is transmitted is placed at one end of the photosensitive drum 51. The other end of the photosensitive drum 51 has a plurality of positioning pins 53 used for positioning the photosensitive drum to the main body of the apparatus, and an electronic module 54 having built-in memory and the like. A photosensitive gear 56 is placed on the rear side of the main body of the apparatus. A male coupling 57 to be engaged with the female coupling 52 of the process cartridge 50 is formed on the photosensitive gear 56, and transmits rotational force to the photosensitive drum 51. Positioning holes 59, into which the positioning pins 53 formed in the other end of the photosensitive drum 51 are to be inserted, are formed in a front side 58 of the main body of the apparatus. A connector or a transceiver unit is disposed in a position opposing the electronic module 54. The electronic module 54 has memory that stores color shift information about mechanical variations, accuracy, and the like, which have arisen during manufacture or assembly of the process cartridge 50. The connector or the transceiver unit arranged in the main body of the apparatus is coupled to a CPU of the main body of the apparatus through wired communication or through wireless communication. The CPU of the main body of the apparatus has memory that stores color shift information, such as a position error of the coupling 57, position errors of the positioning holes 59, an exposure position error, and the like. Further, the CPU has an arithmetic processing device which performs arithmetic processing by combination of the color shift information in the built-in memory of the electronic module 54 of the process cartridge 50 and color shift information in the memory of the main body. Moreover, the main body of the apparatus is provided with an organic EL line head 60, which serves as image-writing means, at a position corresponding to the photosensitive drum 51.

Figure 3:
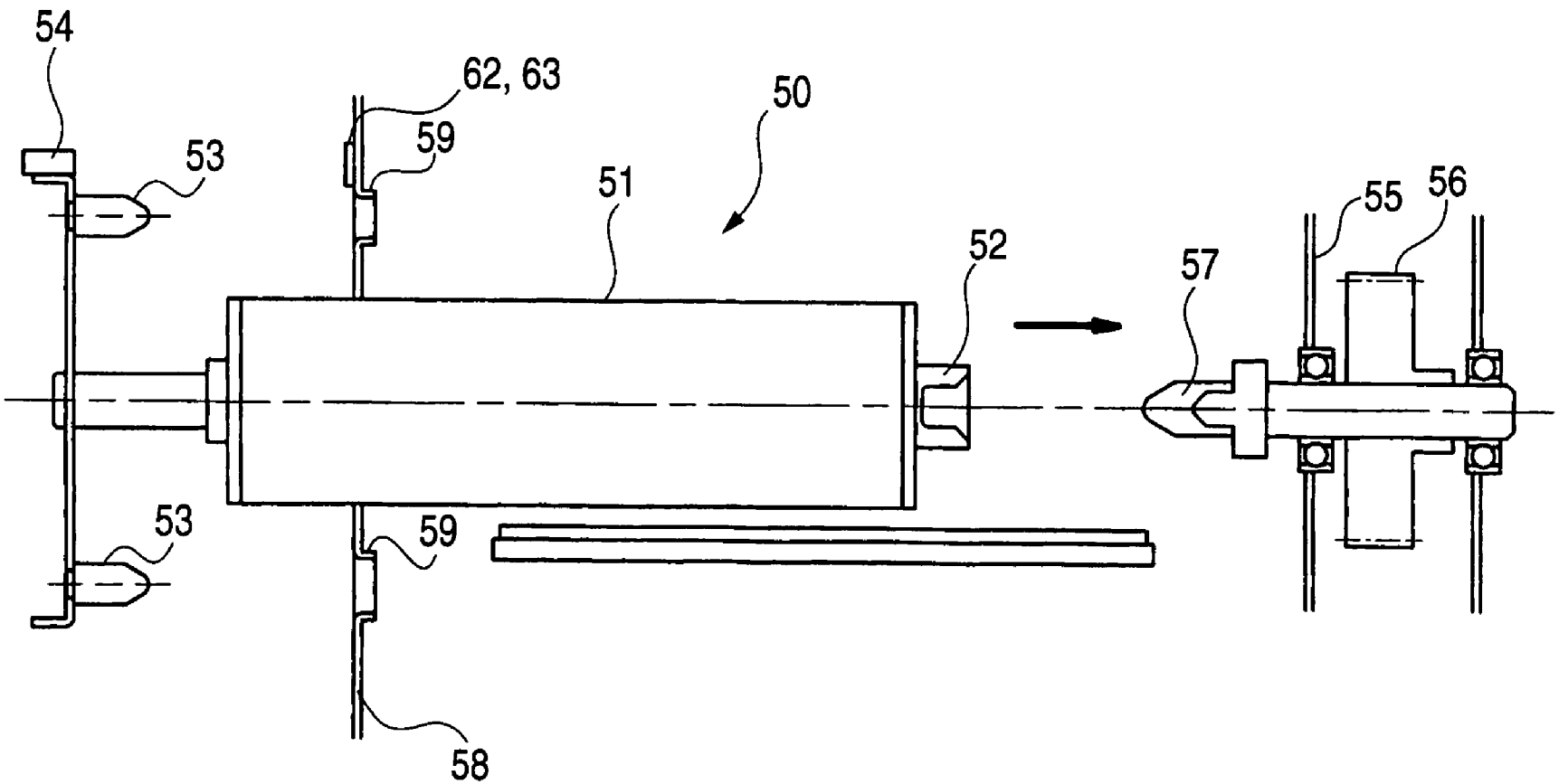
FIG. 3 is a view showing a method for attaching the process cartridge to the image-forming apparatus.

FIG. 3 is a view showing a method for attaching the process cartridge 50 of the present invention to the main body of the apparatus. The process cartridge 50 is axially moved to be attached to the main body of the apparatus.

Figure 4:
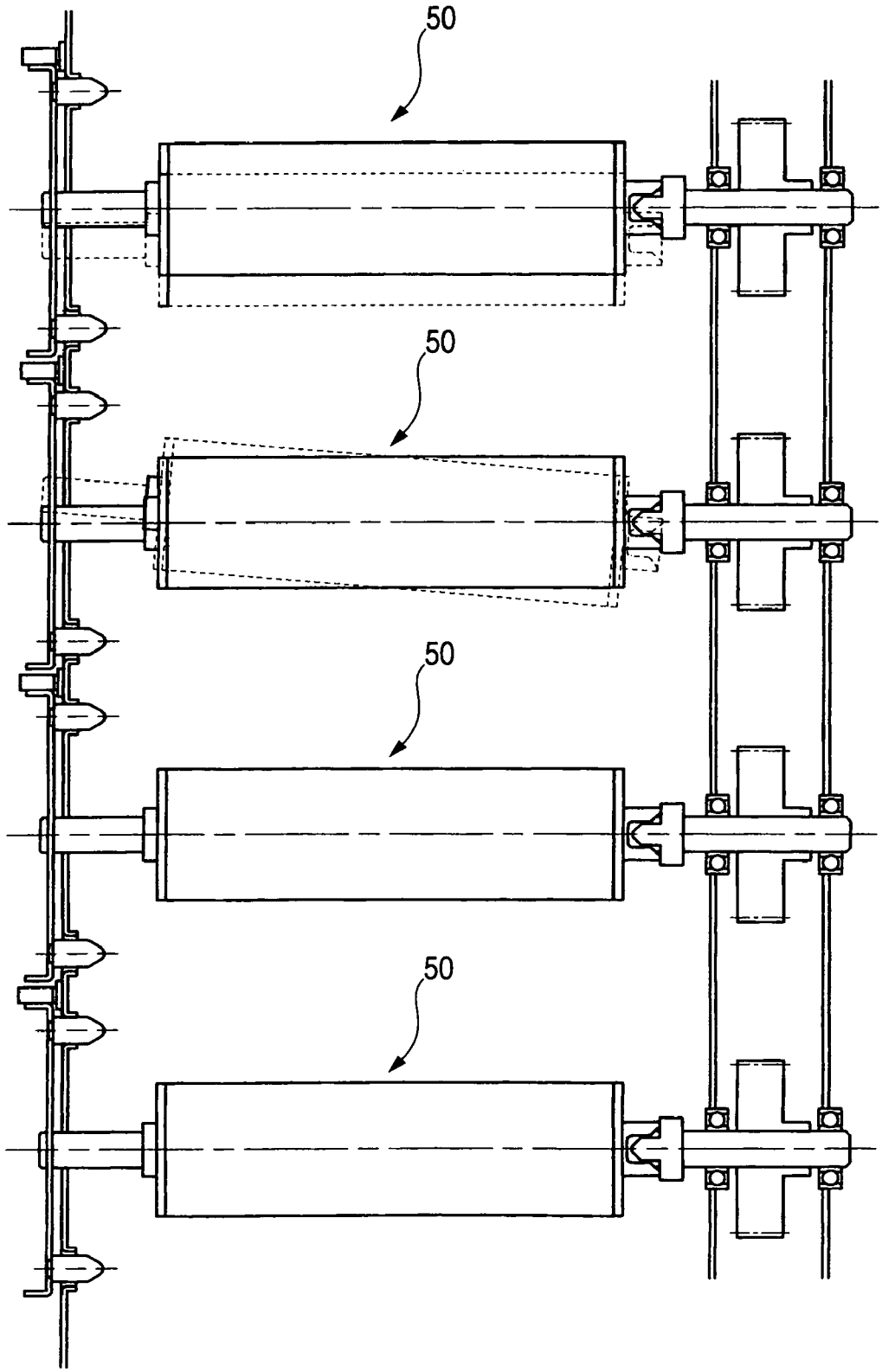
FIG. 4 is a view showing the process cartridges attached to the apparatus anomaly.

FIG. 4 is a view showing an anomaly in the attachment of the process cartridges 50 attached to the main body of the apparatus. The top process cartridge 50 is attached with the photosensitive drum 51 thereof being deviated in a sub-scanning direction. The process cartridge 50 located second from top is attached with the photosensitive drum 51 thereof being twisted. Such anomalies in attachment arise as a result of the error of the process cartridge 50 being combined with an error in the main body of the apparatus.

Figure 5A:
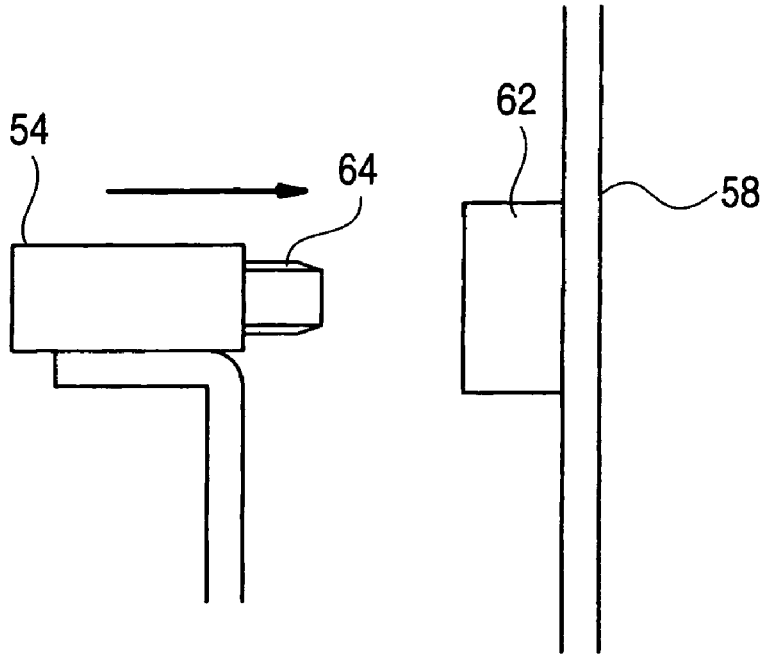
FIGS. 5A and 5B are views showing a state where a wired electronic module is attached to the apparatus.
Figure 5B:
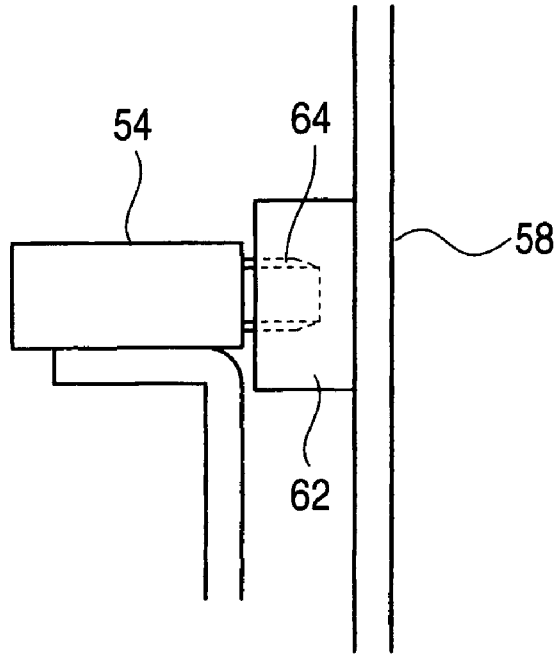

FIGS. 5A and 5B are views showing a state where the wired electronic module 54 is attached to the main body of the apparatus. In this case, the electronic module 54 has an electrode 64, and a connector 62 is provided on the front side 58 of the main body of the apparatus. The electrode 64 is inserted into the connector 62 as a result of the process cartridge 50 having been attached to the main body of the apparatus, whereby the CPU of the main body of the apparatus is connected to the memory in the electronic module 54 by means of wired communication.

Figure 6A:
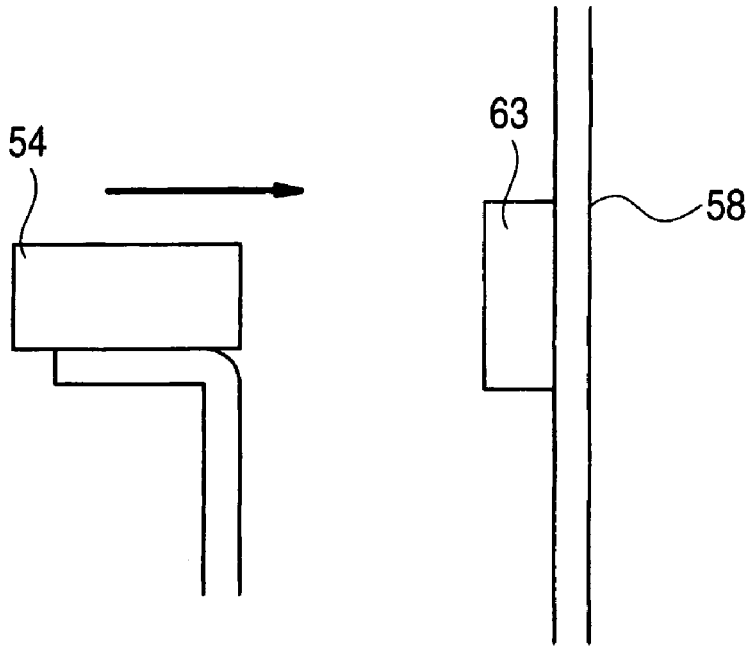
FIGS. 6A and 6B are views showing a state where the wireless electronic module is attached to the apparatus.
Figure 6B:
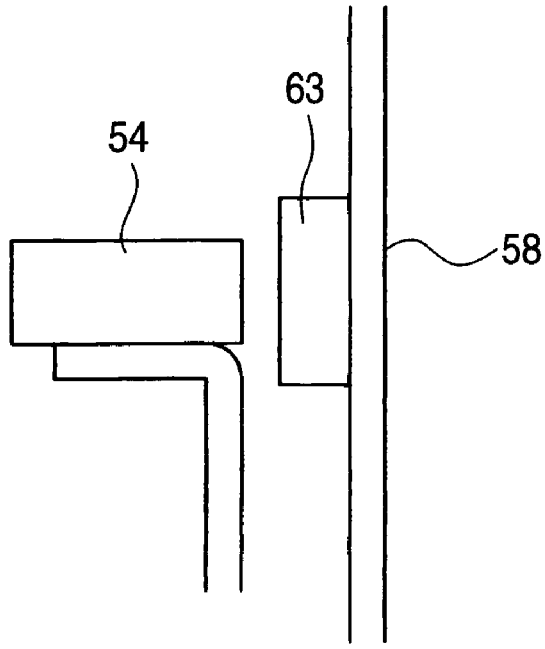

FIGS. 6A and 6B are views showing a state where the wireless electronic module 54 is attached to the main body of the apparatus. In this case, the electronic module 54 has transmission means, and a transceiver unit 63 is provided on the front side 58 of the main body of the apparatus. As a result of the process cartridge 50 having been attached to the main body of the apparatus, the electronic module 54 and the transceiver unit 63 become close to each other, whereby the CPU of the main body of the apparatus and the memory in the electronic module are coupled together by means of wireless communication.

Figure 7:
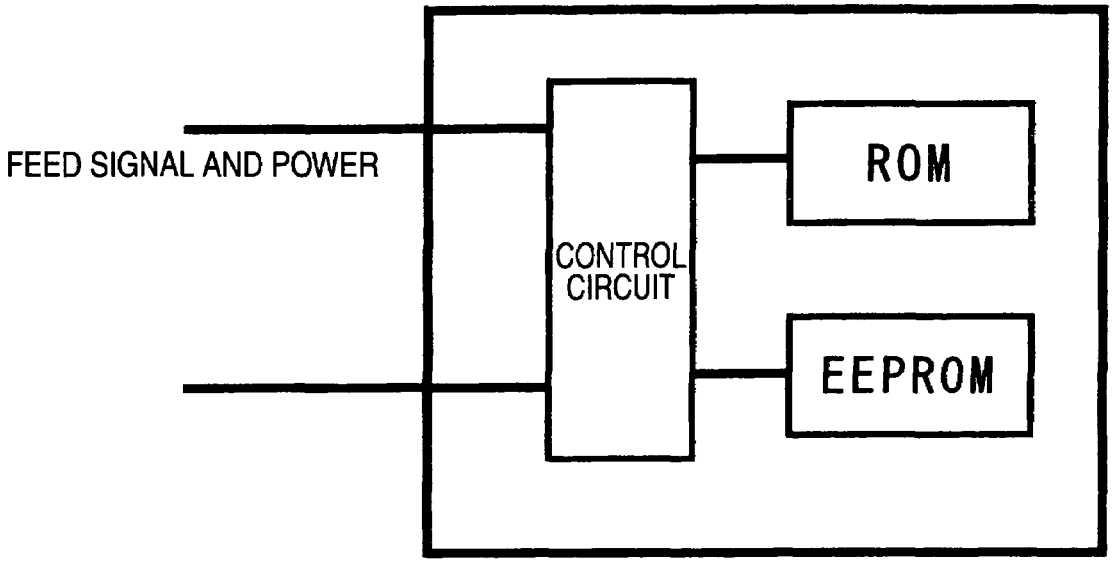
FIG. 7 is a view showing the inside of the wired electronic module.

FIG. 7 is a view showing the inside of the wired electronic module 54. Provided in the wired electronic module 54 are ROM that stores color shift information about mechanical variations, accuracy, and the like, which have arisen during manufacture or assembly of the process cartridge 50; EEPROM that enables writing and erasure of data in accordance with a command from a computer of the main body of the apparatus; and a control circuit. The control circuit is provided with a signal and power by means of wired communication, and the control circuit is coupled to the GND.

Figure 8:
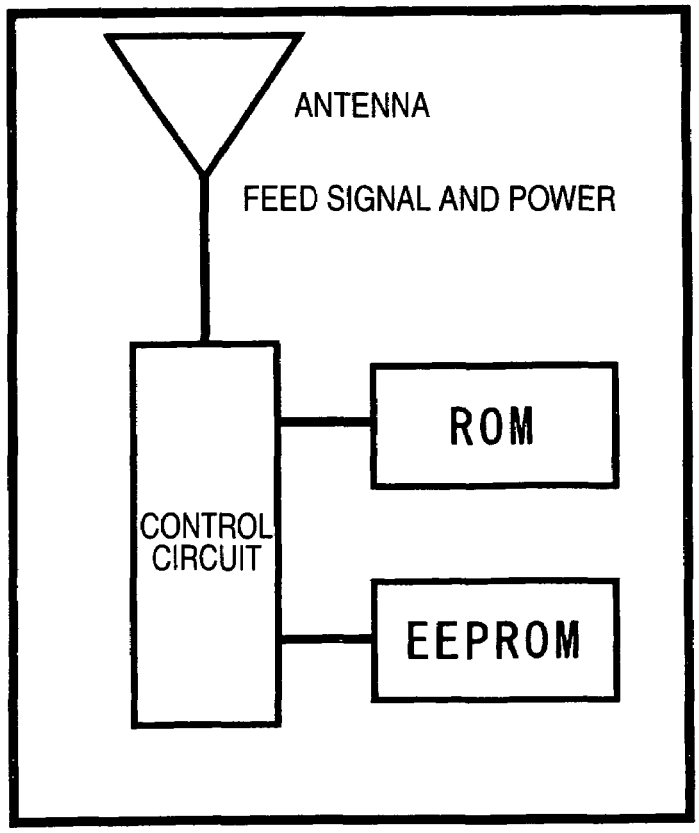
FIG. 8 is a view showing the inside of the wireless electronic module.

FIG. 8 is a view showing the inside of the wireless electronic module 54. Provided in the wireless electronic module 54 are ROM that stores color shift information about mechanical variations, accuracy, and the like, which have arisen during manufacture or assembly of the process cartridge 50; EEPROM that enables writing and erasure of data in accordance with a command from a computer of the main body of the apparatus; and a control circuit. The control circuit is connected to a transceiver antenna, and the transceiver antenna is coupled to the CPU in the main body of the apparatus by way of the transceiver unit 63 disposed on the front side 58 of the main body of the apparatus.

Figure 9:
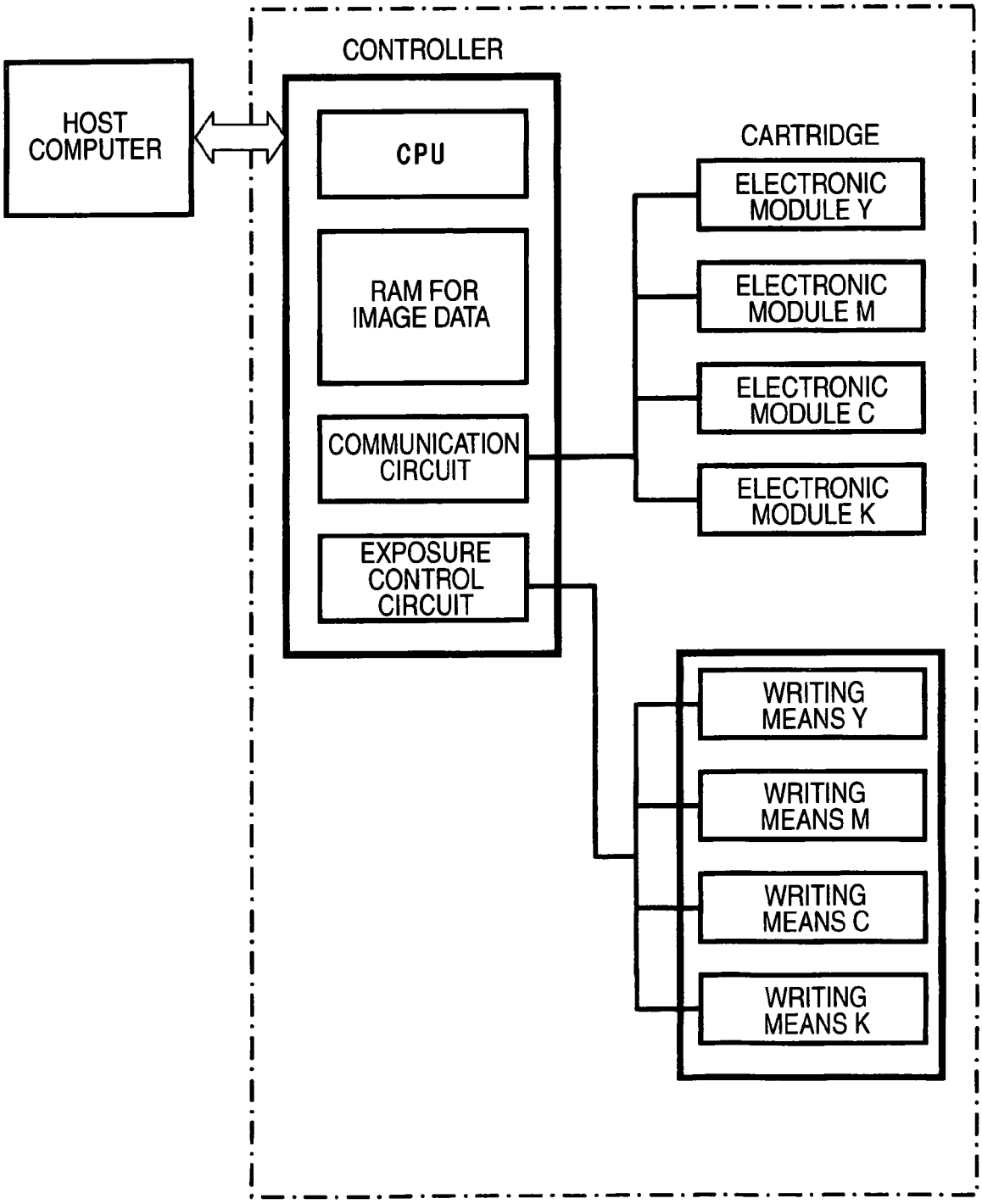
FIG. 9 is a block diagram showing an electrical configuration between the process cartridges and the apparatus.

FIG. 9 is a block diagram showing an electrical configuration between the process cartridges 50 of the image-forming stations Y, M, C, and K and the main body of the apparatus.

Figure 10:
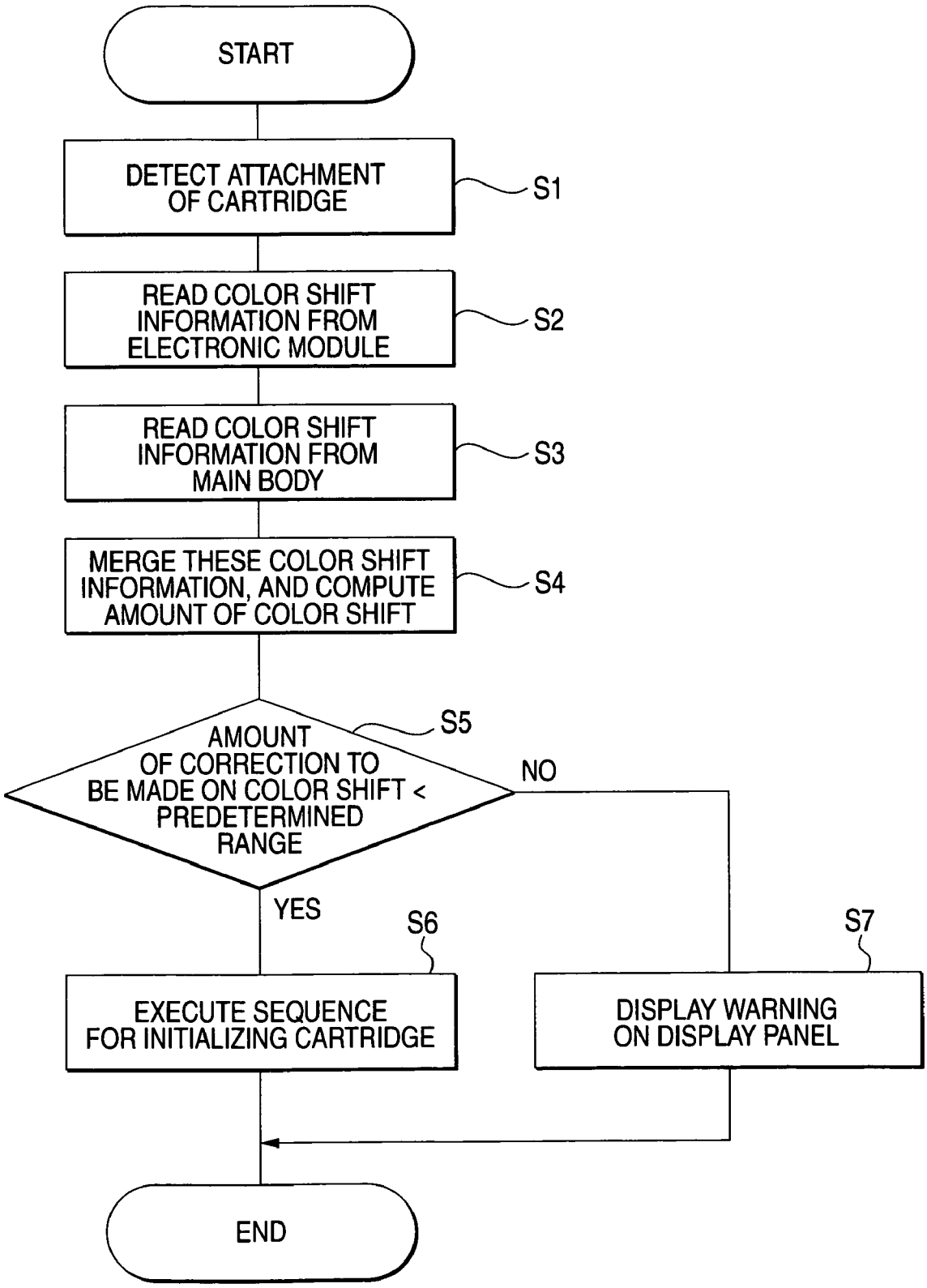
FIG. 10 is a view showing an embodiment of a flowchart of registration correction.

FIG. 10 is a view showing a flowchart of registration correction of a first embodiment of the present invention. In the present embodiment, replacement of the process cartridge 50 cannot be performed during power-off. At power-on, the process cartridges 50 are ascertained to be attached to the main body of the apparatus. Next, color shift information is read from the memory in the electronic module 54 of the process cartridge 50. Subsequently, color shift information is read from the memory in the electronic module 54 of the process cartridge 50, and two items of color shift information are subjected to computation while being merged together, to thus compute the amount of correction to be made on a color shift. A determination is made as to whether or not the thus-computed amount of correction falls within a correctable range. When the result of determination is YES, a sequence for initializing the process cartridge is executed. In contrast, when the result of determination is NO, a warning appears on a display panel.

The first embodiment provides means which inhibits replacement of the process cartridge 50 during power-off. Arithmetic processing is performed after the process cartridge has been ascertained to be attached to the main body of the apparatus during replacement. Hence, there is no necessity for executing arithmetic processing every time power is turned on, which in turn provides a user-friendly apparatus.

Figure 11:
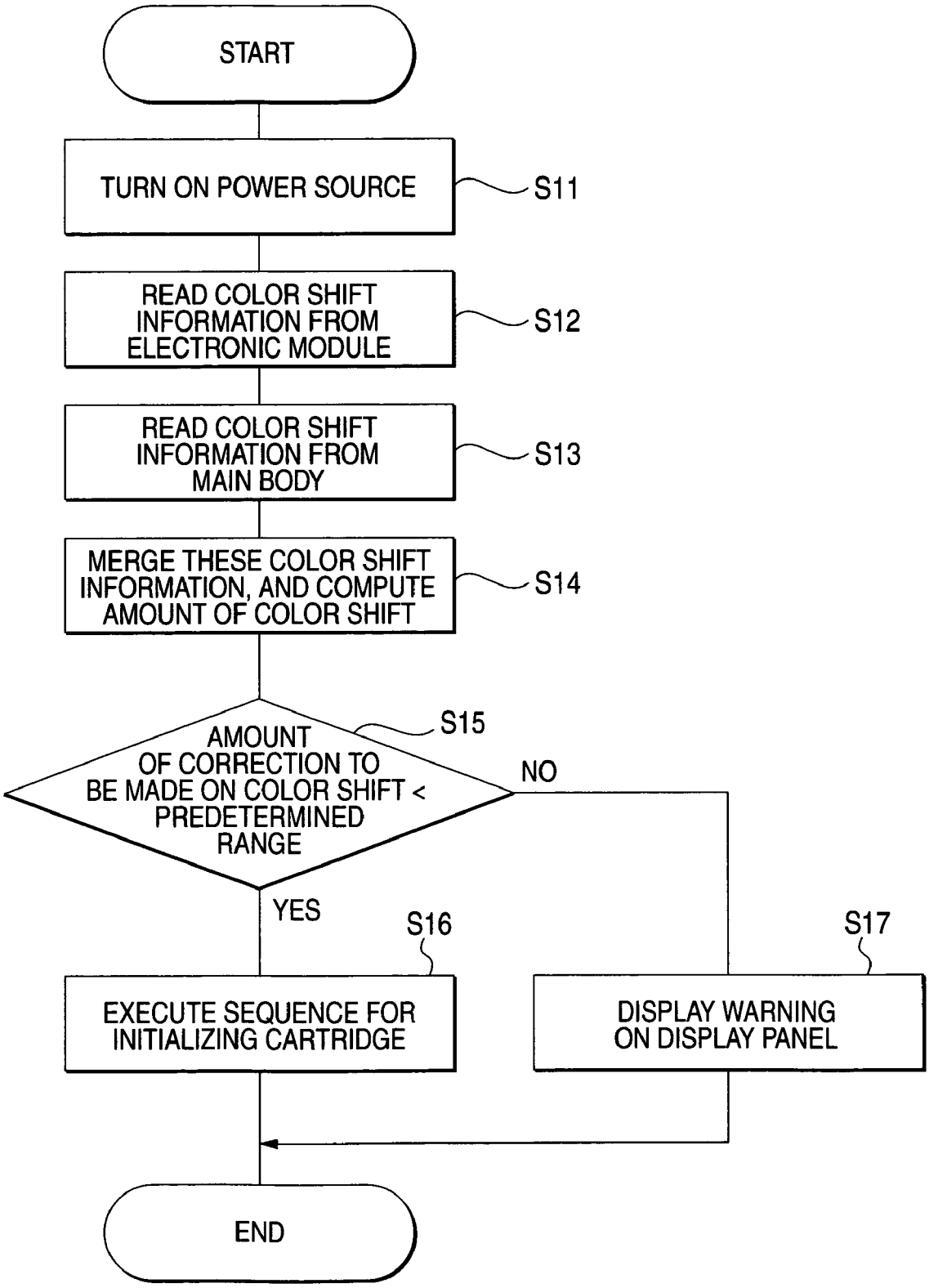
FIG. 11 is a view showing another embodiment of a flowchart of registration correction;.

FIG. 11 is a view showing a flowchart of registration correction of a second embodiment of the present invention. The second embodiment is applicable to an image-forming apparatus which also enables replacement of the process cartridge 50 during power-off. At power-off, the process cartridges 50 is attached to the main body of the apparatus. When power is turned on, color shift information is read from the memory in the electronic module 54 of the process cartridge 50. Subsequently, color shift information is read from the memory in the main body of the apparatus, and two items of color shift information are subjected to computation while being merged together, to thus compute the amount of correction to be made on a color shift. A determination is made as to whether or not the thus-computed amount of correction to be made on a color shift falls within a correctable range. When the result of determination is YES, a sequence for initializing the process cartridge is executed. In contrast, when the result of determination is NO, a warning appears on a display panel.

What is claimed is:

1. An image-forming method performed in an image forming apparatus which comprises:

a first memory, storing first information indicative of a first factor causing color shift; and a detachable process cartridge, provided with an image carrier and a second memory storing second information indicative of a second factor causing the color shift, the method comprising:

reading out the first information and the second information when the image forming apparatus recognizes an attachment of the process cartridge, obtaining an estimated color shift caused by the first factor and the second factor, based on the first information and the second information; and judging whether the estimated color shift is within a predetermined range.

2. The image-forming method according to claim 1, further comprising performing an initialization of the process cartridge when it is judged that the estimated color shift is within the predetermined range.

3. The image-forming method according to claim 1, further comprising issuing an alarm when it is judged that the estimated color shift is not within the predetermined range.

4. The image-forming method according to claim 1, wherein the image forming apparatus allows the attachment of the process cartridge while the image forming apparatus is activated, and the estimated color shift is obtained when the process cartridge is attached.

5. The image-forming method according to claim 4, wherein the attachment of the process cartridge is inhibited while the image forming apparatus is deactivated.

6. The image-forming method according to claim 1, wherein the image forming apparatus allows the attachment of the process cartridge while the image forming apparatus is deactivated, and the estimated color shift is obtained when the image forming apparatus is activated after the process cartridge is attached.

7. The image-forming method according to claim 1, wherein the first factor includes a tolerance generated during a manufacture process of the image-forming apparatus.

8. The image-forming method according to claim 1, wherein the second factor includes a tolerance generated during a manufacture process of the process cartridge.

9. The image-forming method according to claim 1, wherein the second information is read out through wireless communication.

10. The image forming method according to claim 1, wherein the second information is read out through wired communication.

11. An image-forming apparatus comprising:

a first memory, storing first information indicative of a first factor causing color shift;

a detachable process cartridge, provided with an image carrier and a second memory storing a second information indicative of a second factor causing the color shift; and a processor, operable to:

read out the first information and the second information when the image forming apparatus recognizes the attachment of the process cartridge;

estimate the color shift caused by the first factor and the second factor, based on the first information and the second information; and judge whether the estimated color shift is within a predetermined range.

12. The image-forming apparatus according to claim 11, further comprising a controller, operable to perform an initialization of the process cartridge when the processor judges that the estimated color shift is within the predetermined range.

13. The image-forming apparatus according to claim 11, wherein the controller issues an alarm when the processor judges that the estimated color shift is not within the predetermined range.

14. The image-forming apparatus according to claim 11, wherein image-forming apparatus allows the attachment of the process cartridge while the image-forming apparatus is activated, and the processor estimates the color shift when the process cartridge is attached.

15. The image-forming apparatus according to claim 14, wherein the attachment of the process cartridge is inhibited while the image-forming apparatus is deactivated.

16. The image-forming apparatus according to claim 11, wherein the image forming apparatus allows the attachment of the process cartridge while the image-forming apparatus is deactivated, the processor estimates the color shift when the image-forming apparatus is activated after the process cartridge is attached.

17. The image-forming apparatus according to claim 11, wherein the first factor includes a tolerance generated during a manufacture process of the image-forming apparatus.

18. The image-forming apparatus according to claim 11, wherein the second factor includes a tolerance generated during a manufacture process of the process cartridge.

19. The image-forming apparatus according to claim 11, wherein the processor reads out the second information through wireless communication.

20. The image forming apparatus according to claim 11, wherein the processor reads out the second information through wired communication.

* * * * *